US006206656B1

(12) United States Patent
Bailey et al.

(10) Patent No.: US 6,206,656 B1
(45) Date of Patent: Mar. 27, 2001

(54) METHOD OF OPERATING A FREE PISTON INTERNAL COMBUSTION ENGINE WITH HIGH PRESSURE HYDRAULIC FLUID UPON MISFIRE OR INITIAL START-UP

(75) Inventors: Brett M. Bailey, Peoria; Francis J. Raab, Chillicothe, both of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/255,524

(22) Filed: Feb. 22, 1999

(51) Int. Cl.[7] ..... F04B 17/00

(52) U.S. Cl. ..... 417/364; 60/595; 123/46 B; 123/46 R

(58) Field of Search ..... 73/116, 117.2, 73/117.3; 417/364; 60/595; 123/46 R, 46 B

(56) References Cited

U.S. PATENT DOCUMENTS

| | | | |
|---|---|---|---|
| 4,382,748 | * | 5/1983 | Vanderlaan . |
| 4,435,133 | * | 3/1984 | Meulendyk . |
| 4,599,861 | * | 7/1986 | Beaumont . |
| 5,473,893 | * | 12/1995 | Achten et al. . |
| 5,482,445 | * | 1/1996 | Achten et al. . |
| 5,556,262 | * | 9/1996 | Achten et al. . |
| 5,775,273 | * | 7/1998 | Beale . |
| 5,803,028 | * | 9/1998 | Rose . |
| 5,829,393 | * | 11/1998 | Achten et al. . |
| 6,035,637 | * | 3/2000 | Beale et al. . |

FOREIGN PATENT DOCUMENTS

| | | | |
|---|---|---|---|
| 0 254 353 | 1/1988 | (EP) | F02B/71/04 |
| 93/10341 | 5/1993 | (WO) | F02B/71/02 |
| 93/10342 | 5/1993 | (WO) | F02B/71/04 |
| 9603576A1 | 2/1996 | (WO) | F02B/71/04 |
| 96/32576 | 10/1996 | (WO) | F02B/71/04 |

OTHER PUBLICATIONS

TU Dresden—publication date unknown—earliest date 1993—Dresden University in Germany.

* cited by examiner

*Primary Examiner*—Eric S. McCall
(74) *Attorney, Agent, or Firm*—Todd T. Taylor

(57) ABSTRACT

A method of operating a free piston engine of the present invention, includes a housing with a combustion cylinder and a second cylinder. A piston includes a piston head reciprocally disposed within the combustion cylinder, a second head reciprocally disposed within the second cylinder, and a plunger rod interconnecting the piston head with the second head. A supply of hydraulic fluid is pulsed from a high pressure hydraulic accumulator into a pressure chamber in the second cylinder adjacent the second head during a beginning portion of a compression stroke to cause the piston head to move toward a top dead center position. The high pressure hydraulic accumulator is decoupled from the pressure chamber after the pulsing step. A low pressure hydraulic accumulator is coupled with the pressure chamber during a remaining portion of the compression stroke. The high pressure hydraulic accumulator is coupled with the pressure chamber when the piston head is traveling toward a BDC position during a return stroke. A sensor senses a position of the piston which is at or near the BDC position and provides a corresponding signal. The coupling between the high pressure hydraulic accumulator and the pressure chamber is maintained for a period of time, dependent upon the sensor signal.

8 Claims, 5 Drawing Sheets

SES = 1
142
LP VALVE = 1
144
TIME = 0
146
148
PIST SENS ACT TIME < TRET
YES
150
NO
154
HP = 1
156
TIME >= HPPUL
YES
158
LP VALVE ACTIVATED
160
PIST SENS ACT TIME < TRET
NO
YES
162
SES = SES + 1
164
IF SES > 3
NO
YES
166
ENGINE SERVICE SOON LIGHT (SES)
152
RETURN TO MAIN

METHOD OF OPERATING A FREE PISTON INTERNAL COMBUSTION ENGINE WITH HIGH PRESSURE HYDRAULIC FLUID UPON MISFIRE OR INITIAL START-UP

TECHNICAL FIELD

The present invention relates to free piston internal combustion engines, and, more particularly, to a method of operating a free piston internal combustion engine with a hydraulic power output.

BACKGROUND ART

Internal combustion engines typically include a plurality of pistons which are disposed within a plurality of corresponding combustion cylinders. Each of the pistons is pivotally connected to one end of a piston rod, which in turn is pivotally connected at the other end thereof with a common crankshaft. The relative axial displacement of each piston between a top dead center (TDC) position and a bottom dead center (BDC) position is determined by the angular orientation of the crank arm on the crankshaft with which each piston is connected.

A free piston internal combustion engine likewise includes a plurality of pistons which are reciprocally disposed in a plurality of corresponding combustion cylinders. However, the pistons are not interconnected with each other through the use of a crankshaft. Rather, each piston is typically rigidly connected with a plunger rod which is used to provide some type of work output. In a free piston engine with a hydraulic output, the plunger is used to pump hydraulic fluid which can be used for a particular application. Typically, the housing which defines the combustion cylinder also defines a hydraulic cylinder in which the plunger is disposed and an intermediate compression cylinder between the combustion cylinder and the hydraulic cylinder. The combustion cylinder has the largest inside diameter; the compression cylinder has an inside diameter which is smaller than the combustion cylinder; and the hydraulic cylinder has an inside diameter which is still yet smaller than the compression cylinder. A compression head which is attached to and carried by the plunger at a location between the piston head and plunger head has an outside diameter which is just slightly smaller than the inside diameter of the compression cylinder. A high pressure hydraulic accumulator which is fluidly connected with the hydraulic cylinder is pressurized through the reciprocating movement of the plunger during operation of the free piston engine. An additional hydraulic accumulator is selectively interconnected with the area in the compression cylinder to exert a relatively high axial pressure against the compression head and thereby move the piston head toward the TDC position.

With a free piston engine as described above, the piston will not travel to the original BDC position if a misfire occurs during normal operation or at initial start-up. The piston may not travel a sufficient distance which provides an effective compression ratio for subsequently firing the free piston engine. Upon occurrence of a misfire during initial start-up, the piston may need to be manually returned to a BDC position several times until combustion occurs. Each time the piston is retracted to the BDC position during the manual return operation, the exhaust outlet is uncovered and at least a portion of the non-combusted fuel and air mixture flows to the ambient environment. This results in a loss of energy, especially heat, which was previously imparted to the fuel and air mixture during a previous compression stroke. Moreover, the manual return procedure may take several seconds to complete, which a user may find undesirable.

With conventional free piston internal combustion engines, emissions are a critical issue. Start-up of conventional free piston internal combustion engines is one of the worst operating points for control of emissions.

The present invention is directed to overcoming one or more of the problems as set forth above.

SUMMARY OF THE INVENTION

The present invention provides a method of operating a free piston engine in which a high pressure fluid from a high pressure hydraulic accumulator is coupled with a pressure chamber to bounce the piston back toward a TDC position upon occurrence of a misfire or initial start-up condition.

In one aspect of the method of operating a free piston engine of the present invention, a housing includes a combustion cylinder and a second cylinder. A piston includes a piston head reciprocally disposed within the combustion cylinder, a second head reciprocally disposed within the second cylinder, and a plunger rod interconnecting the piston head with the second head. A supply of hydraulic fluid is pulsed from a high pressure hydraulic accumulator into a pressure chamber in the second cylinder adjacent the second head during a beginning portion of a compression stroke to cause the piston head to move toward a TDC position. The high pressure hydraulic accumulator is decoupled from the pressure chamber after the pulsing step. A low pressure hydraulic accumulator is coupled with the pressure chamber during a remaining portion of the compression stroke. The high pressure hydraulic accumulator is coupled with the pressure chamber when the piston head is traveling toward a BDC position during a return stroke. A sensor senses a position of the piston which is at or near the BDC position and provides a corresponding signal. The coupling between the high pressure hydraulic accumulator and the pressure chamber is maintained for a period of time, dependent upon the sensor signal.

An advantage of the present invention is that the piston is bounced back toward a TDC position upon occurrence of a misfire or initial start-up condition.

Another advantage is that a sensor which is used for timing fuel injection is also used to determine when a misfire occurs, and how long a pulse of high pressure fluid is coupled with the pressure chamber.

Yet another advantage is that dependence upon the compression ratio is reduced to facilitate cold starting of the engine.

A further advantage is that the exhaust ports are not opened during initial start-up, thereby preventing unburned fuel from escaping.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
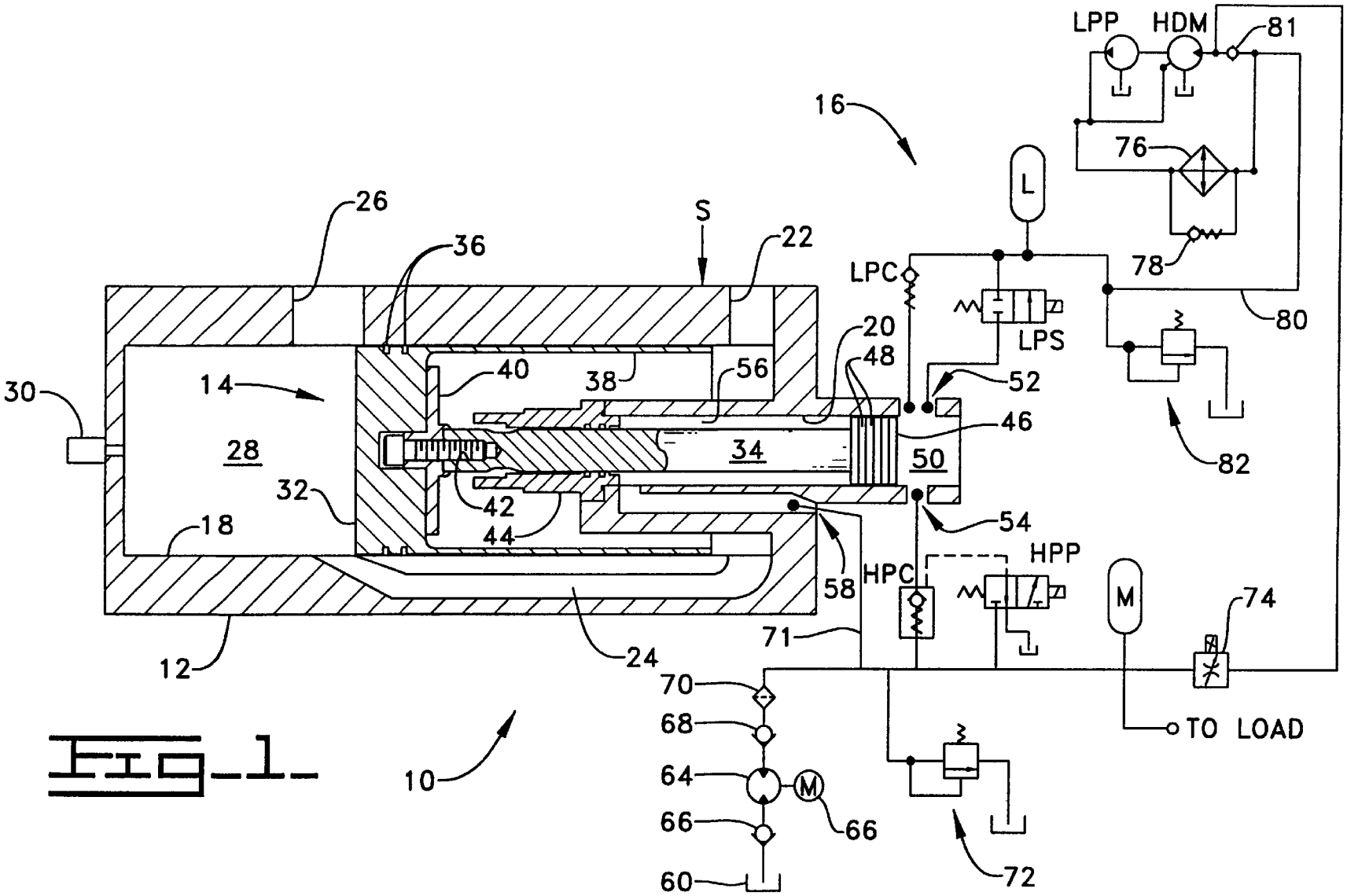
FIG. 1 is a schematic illustration of an embodiment of a free piston engine with which an embodiment of a method of the present invention may be used.

Referring now to the drawings, and more particularly to FIG. 1, there is shown an embodiment of a free piston internal combustion engine 10 which may be used with an embodiment of the method of the present invention, and which generally includes a housing 12, piston 14, and hydraulic circuit 16.

Housing 12 includes a combustion cylinder 18 and a hydraulic cylinder 20. Housing 12 also includes a combustion air inlet 22, air scavenging channel 24 and exhaust outlet 26 which are disposed in communication with a combustion chamber 28 within combustion cylinder 18. Combustion air is transported through combustion air inlet 22 and air scavenging channel 24 into combustion chamber 28 when piston 14 is at or near a BDC position. An appropriate fuel, such as a selected grade of diesel fuel, is injected into combustion chamber 28 as piston 14 moves toward a TDC position using a controllable fuel injector system, shown schematically and referenced as 30. The stroke length of piston 14 between a BDC position and a TDC position may be fixed or variable.

Piston 14 is reciprocally disposed within combustion cylinder 18 and is moveable during a compression stroke toward a TDC position and during a return stroke toward a BDC position. Piston 14 generally includes a piston head 32 which is attached to a plunger rod 34. Piston head 32 is formed from a metallic material in the embodiment shown, such as aluminum or steel, but may be formed from another material having suitable physical properties such as coefficient of friction, coefficient of thermal expansion and temperature resistance. For example, piston head 32 may be formed from a non-metallic material such as a composite or ceramic material. More particularly, piston head 32 may be formed from a carbon—carbon composite material with carbon reinforcing fibers which are randomly oriented or oriented in one or more directions within the carbon and resin matrix.

Piston head 32 includes two annular piston ring groves 36 in which are disposed a pair of corresponding piston rings (not numbered) to prevent blow-by of combustion products on the return stroke of piston 14 during operation. Any number of piston ring grooves 36 and piston rings may be used without changing the essence of the invention. If piston head 32 is formed from a suitable non-metallic material having a relatively low coefficient of thermal expansion, it is possible that the radial operating clearance between piston head 32 and the inside surface of combustion cylinder 18 may be reduced such that piston ring grooves 36 and the associated piston rings may not be required. Piston head 32 also includes an elongated skirt 38 which lies adjacent to and covers exhaust outlet 26 when piston 14 is at or near a TDC position, thereby preventing combustion air which enters through combustion air inlet 22 from exiting out exhaust outlet 26.

Plunger rod 34 is substantially rigidly attached to piston head 32 at one end thereof using a mounting hub 40 and a bolt 42. Bolt 42 extends through a hole (not numbered) in mounting hub 40 and is threadingly engaged with a corresponding hole formed in the end of plunger rod 34. Mounting hub 40 is then attached to the side of piston head 32 opposite combustion chamber 28 in a suitable manner, such as by using bolts, welding, and/or adhesive, etc. A bearing/seal 44 surrounding plunger rod 34 and carried by housing 12 separates combustion cylinder 18 from hydraulic cylinder 20.

Plunger head 46 is substantially rigidly attached to an end of plunger rod 34 opposite from piston head 32. Reciprocating movement of piston head 32 between a BDC position and a TDC position, and vice versa, causes corresponding reciprocating motion of plunger rod 34 and plunger head 46 within hydraulic cylinder 20. Plunger head 46 includes a plurality of sequentially adjacent lands and valleys 48 which effectively seal with and reduce friction between plunger head 46 and an inside surface of hydraulic cylinder 20.

Plunger head 46 and hydraulic cylinder 20 define a variable volume pressure chamber 50 on a side of plunger head 46 generally opposite from plunger rod 34. The volume of pressure chamber 50 varies depending upon the longitudinal position of plunger head 46 within hydraulic cylinder 20. A fluid port 52 and a fluid port 54 are fluidly connected with variable volume pressure chamber 50. An annular space 56 surrounding plunger rod 34 is disposed in fluid communication with a fluid port 58 in housing 12. Fluid is drawn through fluid port 58 into annular space 56 upon movement of plunger rod 34 and plunger head 46 toward a BDC position so that a negative pressure is not created on the side of plunger head 46 opposite variable volume pressure chamber 50. The effective cross-sectional area of pressurized fluid acting on plunger head 46 within variable volume pressure chamber 50 compared with the effective cross-sectional area of pressured fluid acting on plunger head 46 within annular space 56, is a ratio of between approximately 5:1 to 30:1. In the embodiment shown, the ratio between effective cross-sectional areas acting on opposite sides of plunger head 46 is approximately 20:1. This ratio has been found suitable to prevent the development of a negative pressure within annular space 56 upon movement of plunger head 46 toward a BDC position, while at the same time not substantially adversely affecting the efficiency of free piston engine 10 while plunger head 46 is traveling toward a TDC position.

Hydraulic circuit 16 is connected with hydraulic cylinder 20 and provides a source of pressurized fluid, such as hydraulic fluid, to a load for a specific application, such as a hydrostatic drive unit (not shown). Hydraulic circuit 16 generally includes a high pressure hydraulic accumulator H, a low pressure hydraulic accumulator L, and suitable valving, etc. used to connect high pressure hydraulic accumulator H and low pressure hydraulic accumulator L with hydraulic cylinder 20 at selected points in time as will be described in greater detail hereinafter.

More particularly, hydraulic circuit 16 receives hydraulic fluid from a source 60 to initially charge high pressure hydraulic accumulator H to a desired pressure. A starter motor 62 drives a fluid pump 64 to pressurize the hydraulic fluid in high pressure hydraulic accumulator H. The hydraulic fluid transported by pump 64 flows through a check valve 66 on an input side of pump 64, and a check valve 68 and filter 70 on an output side of pump 64. The pressure developed by pump 64 also pressurizes annular space 56 via the interconnection with line 71 and fluid port 58. A pressure relief valve 72 ensures that the pressure within high pressure hydraulic accumulator H does not exceed a threshold limit.

The high pressure hydraulic fluid which is stored within high pressure hydraulic accumulator H is supplied to a load suitable for a specific application, such as a hydrostatic drive unit. The high pressure within high pressure hydraulic accumulator H is initially developed using pump 64, and is thereafter developed and maintained using the pumping action of free piston engine 10.

A proportional valve 74 has an input disposed in communication with high pressure hydraulic accumulator H, and provides the dual functionality of charging low pressure hydraulic accumulator L and providing a source of fluid power for driving ancillary mechanical equipment on free piston engine 10. More particularly, proportional valve 74 provides a variably controlled flow rate of high pressure hydraulic fluid from high pressure hydraulic accumulator H to a hydraulic motor HDM. Hydraulic motor HDM has a rotating mechanical output shaft which drives ancillary equipment on free piston engine 10 using a belt and pulley arrangement, such as a cooling fan, alternator and water pump. of course, the ancillary equipment driven by hydraulic motor HDM may vary from one application to another.

Hydraulic motor HDM also drives a low pressure pump LPP which is used to charge low pressure hydraulic accumulator L to a desired pressure. Low pressure pump LPP has a fluid output which is connected in parallel with each of a heat exchanger 76 and a check valve 78. If the flow rate through heat exchanger 76 is not sufficient to provide an adequate flow for a required demand, the pressure differential on opposite sides of check valve 78 causes check valve 78 to open, thereby allowing hydraulic fluid to by-pass heat exchanger 76 temporarily. If the pressure developed by low pressure pump LPP which is present in line 80 exceeds a threshold value, check valve 81 opens to allow hydraulic fluid to bleed back to the input side of hydraulic motor HDM. A pressure relief valve 82 prevents the hydraulic fluid within line 80 from exceeding a threshold value.

Low pressure hydraulic accumulator L selectively provides a relatively lower pressure hydraulic fluid to pressure chamber 50 within hydraulic cylinder 20 using a low pressure check valve LPC and a low pressure shutoff valve LPS. Conversely, high pressure hydraulic accumulator H provides a higher pressure hydraulic fluid to pressure chamber 50 within hydraulic cylinder 20 using a high pressure check valve HPC and a high pressure pilot valve HPP.

During an initial start-up phase of free piston engine 10, starter motor 62 is energized to drive pump 64 and thereby pressurize high pressure hydraulic accumulator H to a desired pressure. Since piston 14 may not be at a position which is near enough to the BDC position to allow effective compression during a compression stroke, it may be necessary to effect a manual return procedure of piston 14 to a BDC position. To wit, low pressure shutoff valve LPS is opened using a suitable controller to minimize the pressure on the side of hydraulic plunger 46 which is adjacent to pressure chamber 50. Since annular space 56 is in communication with high pressure hydraulic accumulator H, the pressure differential on opposite sides of hydraulic plunger 46 causes piston 14 to move toward the BDC position, as shown in FIG. 1.

When piston 14 is at a position providing an effective compression ratio within combustion chamber 28, high pressure pilot valve HPP is actuated using a controller to manually open high pressure check valve HPC, thereby providing a pulse of high pressure hydraulic fluid from high pressure hydraulic accumulator into pressure chamber 50. Low pressure check valve LPC and low pressure shutoff valve LPS are both closed when the pulse of high pressure hydraulic fluid is provided to pressure chamber 50. The high pressure pulse of hydraulic fluid causes plunger head 46 and piston head 32 to move toward the TDC position. Because of the relatively large ratio difference in cross-sectional areas on opposite sides of plunger head 46, the high pressure hydraulic fluid which is present within annual space 56 does not adversely interfere with the travel of plunger head 46 and piston head 32 toward the TDC position. The pulse of high pressure hydraulic fluid is applied to pressure chamber 50 for a period of time which is sufficient to cause piston 14 to travel with a kinetic energy which will effect combustion within combustion chamber 28. The pulse may be based upon a time duration or a sensed position of piston head 32 within combustion cylinder 18.

As plunger head 46 travels toward the TDC position, the volume of pressure chamber 50 increases. The increased volume in turn results in a decrease in the pressure within pressure chamber 50 which causes high pressure check valve HPC to close and low pressure check valve LPC to open. The relatively lower pressure hydraulic fluid which is in low pressure hydraulic accumulator L thus fills the volume within pressure chamber 50 as plunger head 46 travels toward the TDC position. By using only a pulse of pressure from high pressure hydraulic accumulator H during a beginning portion of the compression stroke (e.g., during 60% of the stroke length), followed by a fill of pressure chamber 50 with a lower pressure hydraulic fluid from low pressure hydraulic accumulator L, a net resultant gain in pressure within high pressure hydraulic accumulator H is achieved.

By properly loading combustion air and fuel into combustion chamber 28 through air scavenging channel 24 and fuel injector 30, respectively, proper combustion occurs within combustion chamber 28 at or near a TDC position. As piston 14 travels toward a BDC position after combustion, the volume decreases and pressure increases within pressure 50. The increasing pressure causes low pressure check valve LPC to close and high pressure check valve HPC to open. The high pressure hydraulic fluid which is forced through high pressure check valve during the return stroke is in communication with high pressure hydraulic accumulator H, resulting in a net positive gain in pressure within high pressure hydraulic accumulator H.

Figure 2:
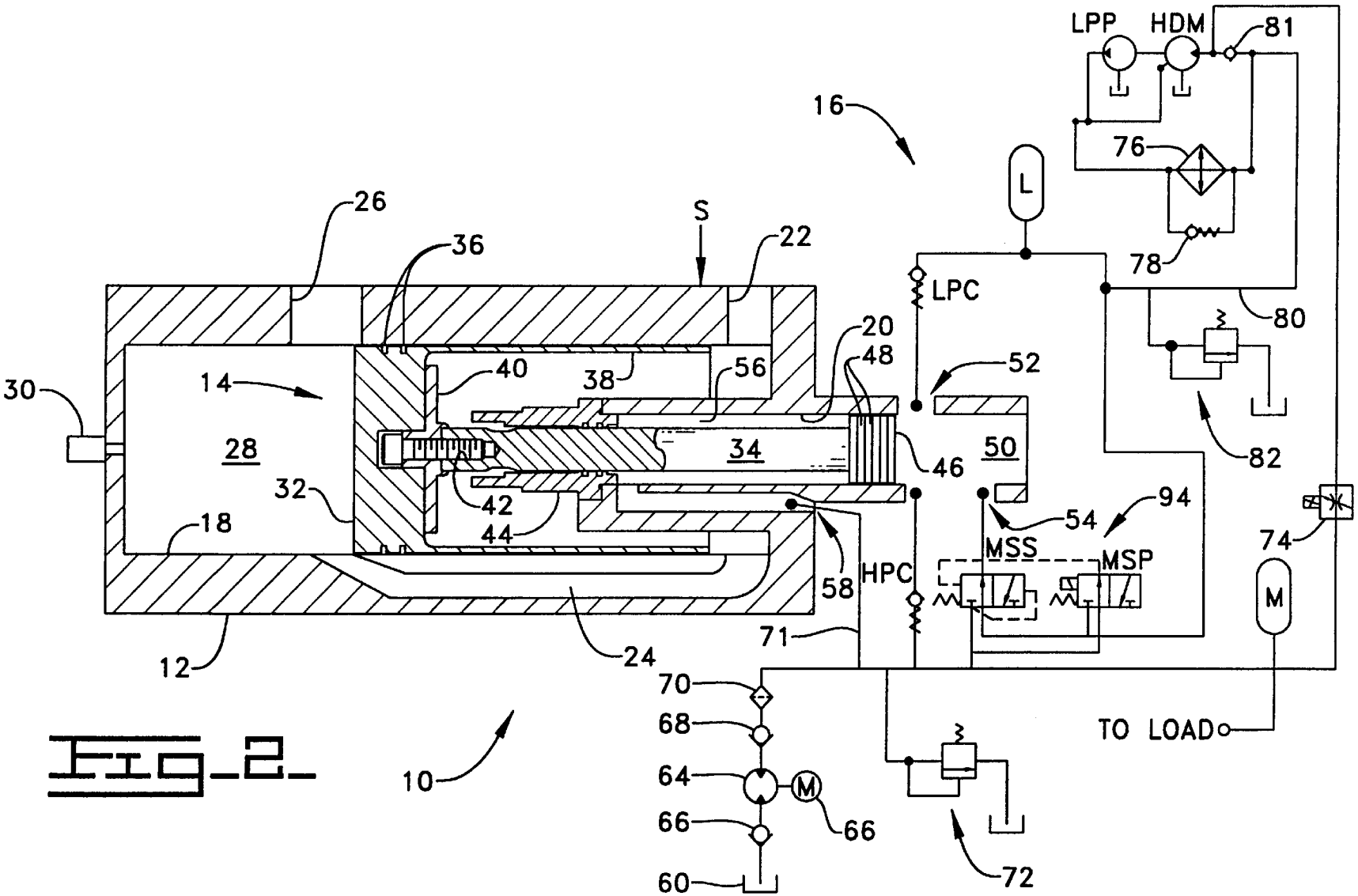
FIG. 2 is a schematic illustration of another embodiment of a free piston engine with which another embodiment of a method of the present invention may be used.

FIG. 2 illustrates another embodiment of a free piston internal combustion engine 90 which may be used with an embodiment of the method of the present invention, and which includes a combustion cylinder and piston arrangement which is substantially the same as the embodiment shown in FIG. 1. Hydraulic circuit 92 of free piston engine 90 also includes many hydraulic components which are the same as the embodiment of hydraulic circuit 16 shown in FIG. 1. Hydraulic circuit 92 principally differs from hydraulic circuit 16 in that hydraulic circuit 92 includes a mini-servo valve 94 with a mini-servo main spool MSS and a mini-servo pilot MSP. Mini-servo main spool MSS is controllably actuated at selected points in time during operation of free piston engine 90 to effect the high pressure pulse of high pressure hydraulic fluid from high pressure hydraulic accumulator H, similar to the manner described above with regard to the embodiment shown in FIG. 1. Mini-servo pilot MSP is controllably actuated to provide the pressure necessary for controllably actuating mini-servo main spool MSS. The pulse of high pressure hydraulic fluid is provided to pressure chamber 50 for a duration which is either dependent upon time or a sensed position of piston 14. As the volume within pressure chamber 50 increases, the pressure correspondingly decreases, resulting in an opening of low pressure check valve LPC. Low pressure hydraulic fluid from low pressure hydraulic accumulator L thus flows into pressure chamber 50 during the compression stroke of piston 14. After combustion and during the return stroke of piston 14, the pressure within pressure chamber 50 increases, thereby causing low pressure check valve LPC to close and high pressure check valve HPC to open. The high pressure hydraulic fluid created within pressure chamber 50 during the return stroke of piston 14 is pumped through high pressure check valve HPC and into high pressure hydraulic accumulator H, thereby resulting in a net positive gain in the pressure within high pressure hydraulic accumulator H.

Figure 3:
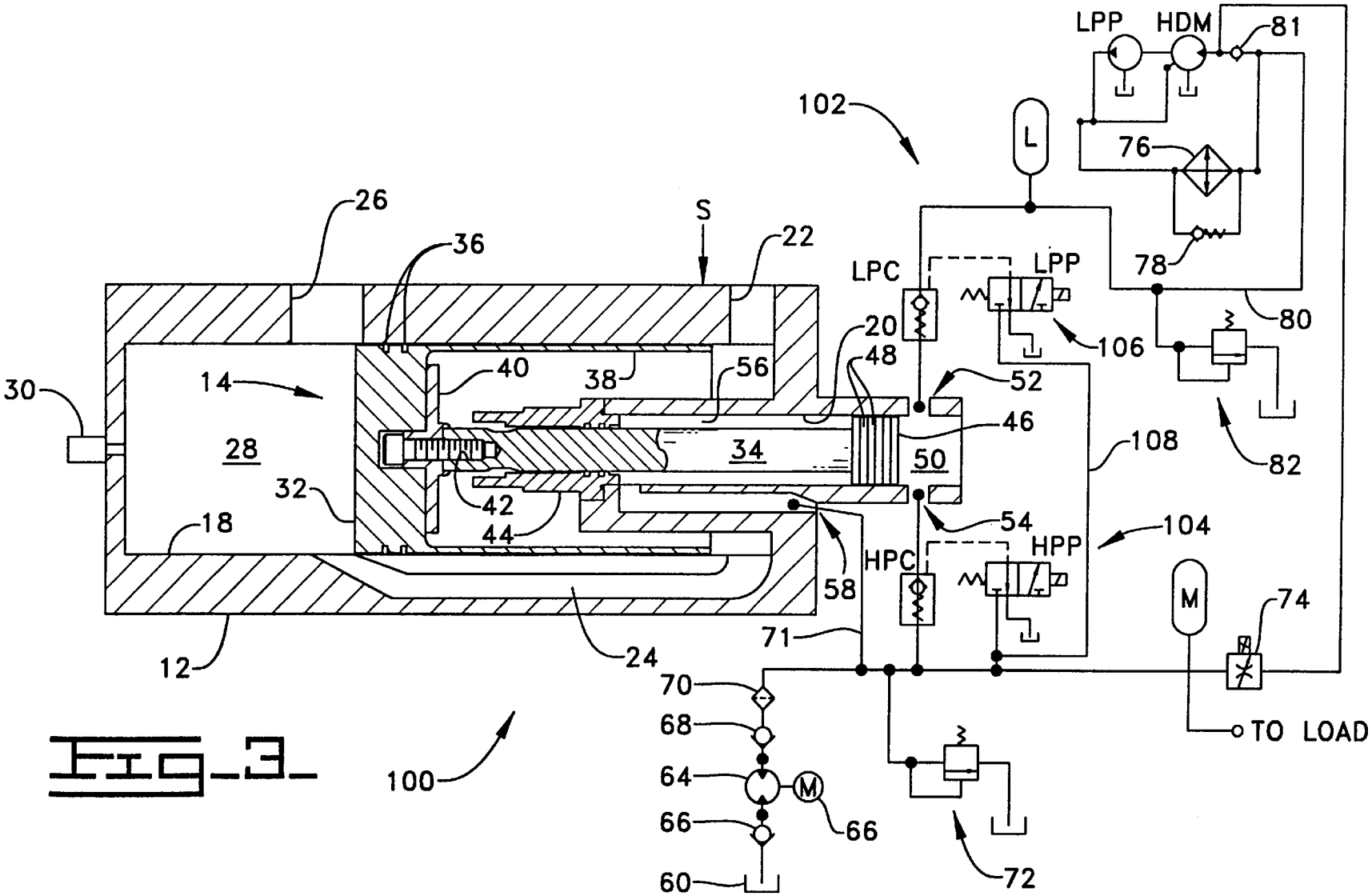
FIG. 3 is a schematic illustration of yet another embodiment of a free piston engine with which another embodiment of a method of the present invention may be used.

Referring now to FIG. 3 there is shown yet another embodiment of a free piston engine 100 with which the method of the present invention may be used. Again, the arrangement of combustion cylinder 18 and piston 14 is substantially the same as the embodiment of free piston engines 10 and 90 shown in FIGS. 1 and 2. Hydraulic circuit 102 also likewise includes many hydraulic components which are the same as the embodiments of hydraulic circuits 16 and 92 shown in FIGS. 1 and 2. However, hydraulic circuit 102 includes two pilot operated check valves 104 and 106. Pilot operated check valve 104 includes a high pressure check valve HPC and a high pressure pilot valve HPP which operate in a manner similar to high pressure check valve HPC and high pressure pilot valve HPP described above with reference to the embodiment shown in FIG. 1. Pilot operated check valve 106 includes a low pressure check valve LPC and a low pressure pilot valve LPP which also work in a manner similar to high pressure check valve 104. The input side of low pressure pilot valve LPP is connected with the high pressure fluid within high pressure hydraulic accumulator H through line 108. Low pressure pilot valve LPP may be controllably actuated using a controller to provide a pulse of pressurized fluid to low pressure check valve LPC which is sufficient to open low pressure check valve LPC.

During use, a pulse of high pressure hydraulic fluid may be provided to pressure chamber 50 using pilot operated check valve 104 to cause piston 14 to travel toward a TDC position with enough kinetic energy to effect combustion. High pressure pilot valve HPP is deactuated, dependent upon a period of time or a sensed position of piston 14, to thereby allow high pressure check valve HPC to close. As plunger head 46 moves toward the TDC position, the pressure within pressure chamber 50 decreases and low pressure check valve LPC is opened. Low pressure hydraulic fluid thus fills the volume within pressure chamber 50 while the volume within pressure chamber 50 expands. After combustion, piston 14 moves toward a BDC position which causes the pressure within pressure chamber 50 to increase. The increase causes low pressure check valve LPC to close and high pressure check valve to open. The high pressure hydraulic fluid which is generated by the pumping action of plunger head 46 within hydraulic cylinder 20 flows into high pressure hydraulic accumulator H, resulting in a net positive gain in the pressure within high pressure hydraulic accumulator H. A sensor (schematically illustrated and positioned at S) detects piston 14 near a BDC position. The high pressure pulse to effect the compression stroke can be timed dependent upon the sensor activation signal.

To effect a manual return procedure using the embodiment of free piston engine 100 shown in FIG. 3, high pressure hydraulic fluid is provided into annular space 56 from high pressure hydraulic accumulator H. Low pressure pilot valve LPP is controllably actuated to cause low pressure check valve LPC to open. The pressure differential on opposite sides of plunger head 46 causes piston 14 to move toward a BDC position. When piston 14 is at a position providing an effective compression ratio to effect combustion within combustion chamber 28, a high pressure pulse of hydraulic fluid is transported into pressure chamber 50 using pilot operated check valve 104 to begin the compression stroke of piston 14.

Figure 4:
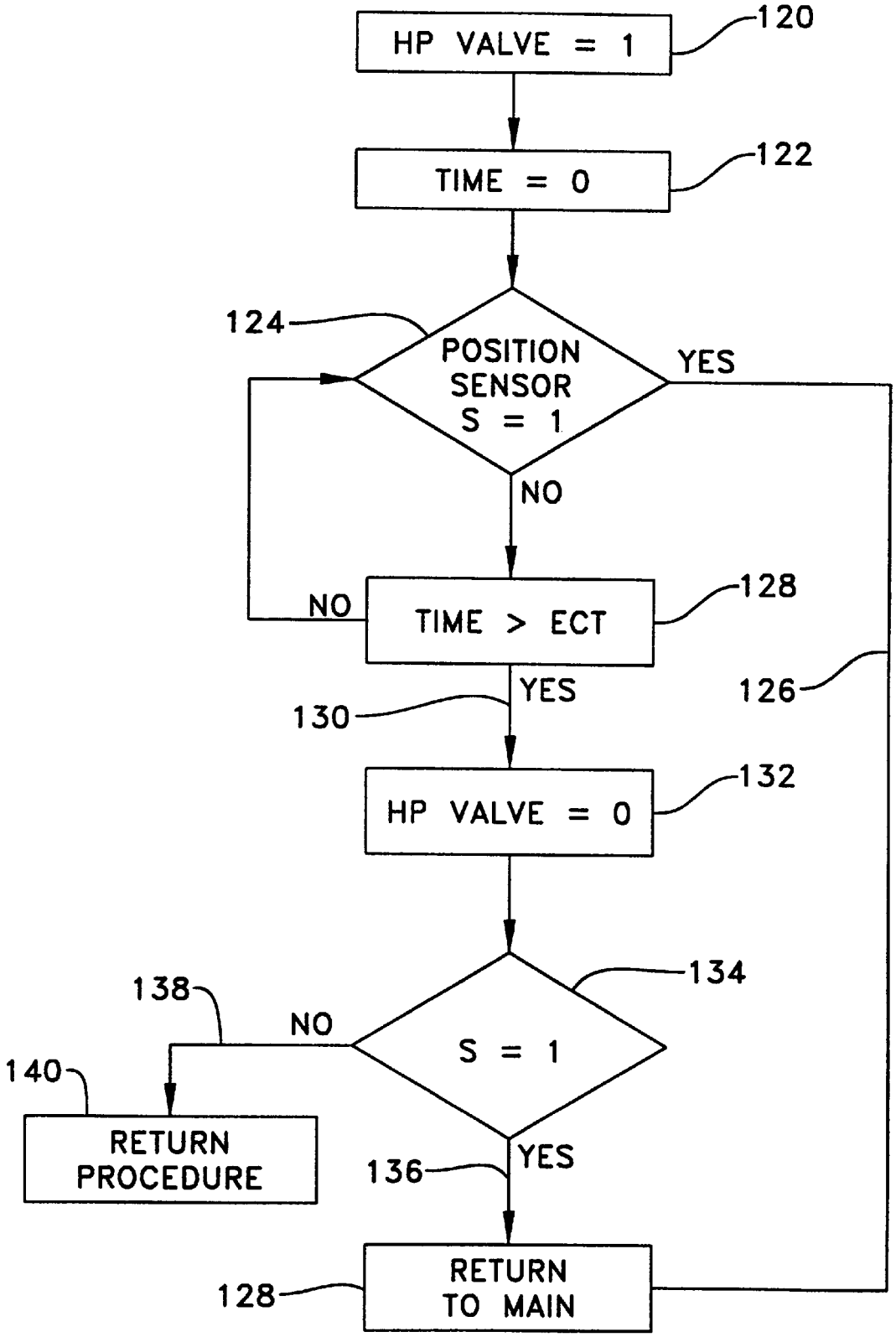
FIG. 4 is a flow chart illustrating an embodiment of a method of the present invention for operation of the free piston engine of FIG. 1 upon occurrence of a misfire condition.

Referring now to FIG. 4, an embodiment of the method of the present invention for operation of the free piston engine upon occurrence of a misfire condition will be described in greater detail. In the embodiment shown in FIG. 4, the method is assumed to be carried out using free piston engine 10. However, it will be appreciated that the embodiment of the method shown in FIG. 4 is equally applicable to other embodiments of a free piston engine, such as free piston engines 90 and 100 shown in FIGS. 2 and 3.

At block 120, the high pressure valve is set to "1", meaning that high pressure check valve HPC is opened as piston 14 begins traveling toward a BDC position. The variable "time" is set to "0" (block 122) substantially concurrently with the opening of high pressure check valve HPC and is incremented using, e.g., a timer circuit or the like. A wait state then occurs, dependent upon whether piston 14 travels to a position at or near a BDC position and activates position sensor S (decision block 124). When sensor S is activated, the value of sensor S equals "1". During the wait state, the variable "time" is incremented and compared with a constant value representing a maximum threshold limit for an extended combustion time (ECT; block 128). If the position sensor is activated before the variable "time" exceeds the constant ECT (line 126), then the misfire was only temporary and control passes back to the main control routine for normal operation of free piston engine 10 (block 128). On the other hand, if the position sensor was not activated and the variable "time" becomes greater than the constant ECT (block 128 and line 130), then free piston engine 10 did not recover from the misfire and the high pressure valve is turned OFF (block 132). A final check is again made to determine whether piston 14 moved to a position at or near a BDC position such that position sensor S was activated (decision block 134). If sensor S was activated, then free piston engine 10 may again be fired and control passes back to the main control routine (line 136). On the other hand, if position sensor S is still not activated (line 138), then a manual return procedure is initiated, as will be described in further detail with reference to FIG. 5.

From the foregoing description of the method of operating free piston engine 10 during a misfire condition, it is apparent that the high pressure check valve is maintained in an ON position during the wait state associated with activation of position sensor S. This is accomplished by actuating high pressure pilot valve HPP to hold high pressure check valve HPC in an open condition, regardless of the position of piston 14. If position sensor S is not activated, the high pressure hydraulic fluid within high pressure hydraulic accumulator H is maintained in a coupled relationship with pressure chamber 50, thereby causing piston 14 to bounce back toward a TDC position during a next compression stroke. Because only a pulse of high pressure hydraulic fluid is transported into pressure chamber 50 during an initial compression stroke, piston 14 will only travel approximately a same distance in a return stroke to maintain a conservation of energy. That is, e.g., if the high pressure hydraulic fluid pulse was applied for approximately 60% of the compression stroke, then piston 14 would travel approximately 60% of the distance toward the original BDC position. Since piston 14 does not travel all the way to the original BDC position, piston 14 does not uncover air scavenging channel 24 or exhaust outlet 26 upon occurrence of a misfire when combustion does not occur. The energy which is contained within the non-combusted fuel and air mixture therefore is not exhausted to the ambient environment and may be compressed during a next compression stroke. The high pressure hydraulic fluid which is maintained within pressure chamber 50 causes piston 14 to bounce back toward the TDC position and again compress the noncombusted fuel and air mixture. When enough energy has been added to the fuel and air mixture, combustion will occur and cause piston 14 to move to the BDC position and activate sensor S.

Figure 5:
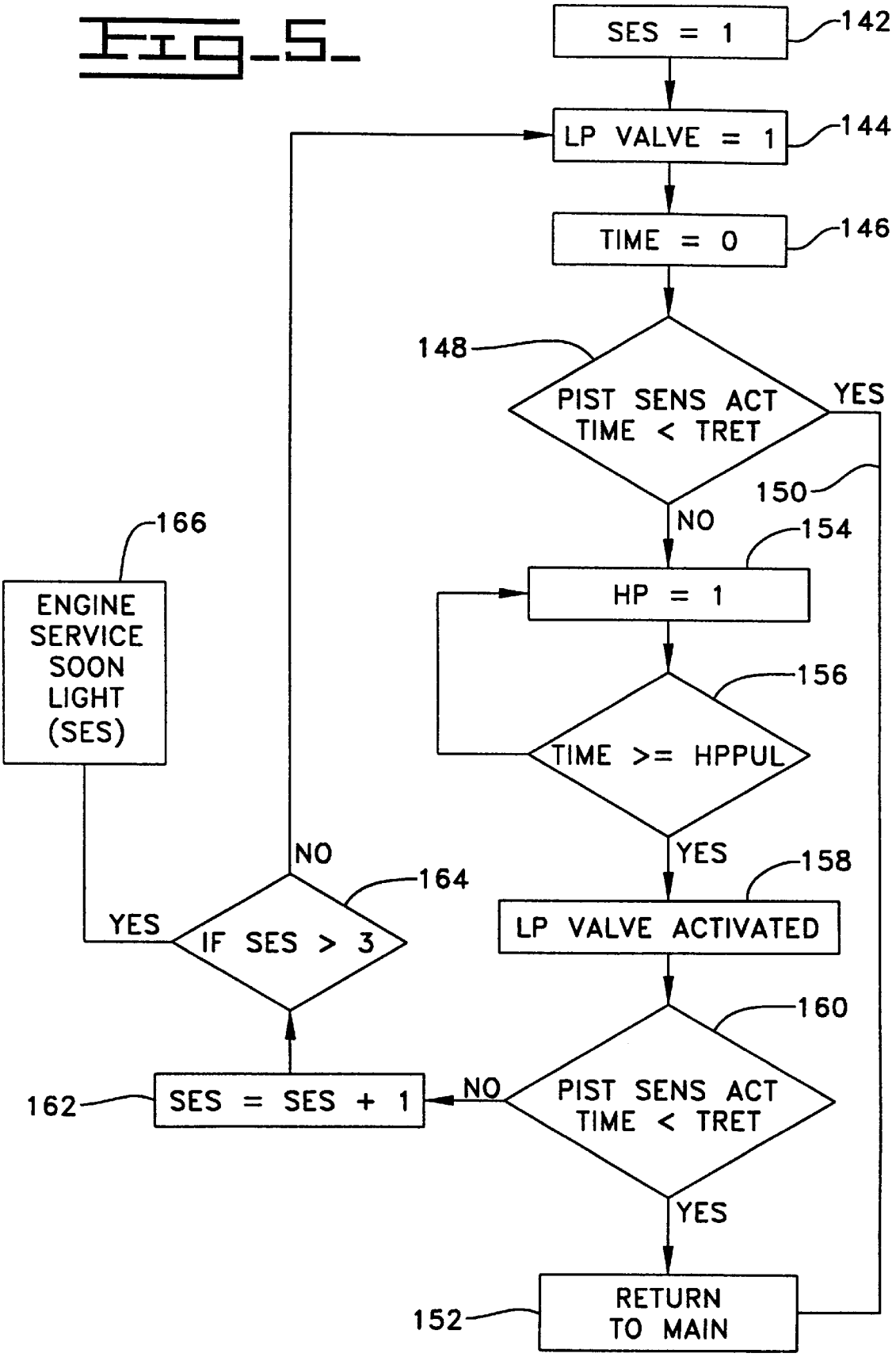
FIG. 5 is a flow chart illustrating an embodiment of a method of the present invention for a manual return procedure of the free piston engine of FIG. 1.

Referring now to FIG. 5, the manual return procedure simplistically referenced at block 140 in FIG. 4 will be described in greater detail. Preliminarily, a variable SES (representing an acronym for "service engine soon" is set to zero (block 142). Low pressure shutoff valve LPS is opened to couple low pressure hydraulic accumulator L with pressure chamber 50 (block 144). Since fluid port 58 is always in communication with annular space 56, opening low pressure shutoff valve LPS causes a pressure differential on opposite sides of plunger head 46 to move piston 14 to a BDC position. A variable "time" is set to "0" substantially concurrently with the opening of low pressure shutoff valve LPS, and is incremented using conventional timer circuitry. A wait state then occurs until piston 14 is sensed at or near a BDC position using sensor S (decision block 148). If sensor S is activated before a maximum threshold time allowed for the return procedure ($T_{RET}$), then control passes back to the main control for normal operation of free piston engine 10 (line 150 and block 152). On the other hand, if the opening of low pressure shutoff valve LPS did not result in piston 14 actuating sensor S within the allowed time $T_{RET}$, then low pressure shutoff valve LPS is deactivated and high pressure pilot valve HPP is activated to cause high pressure hydraulic fluid to flow into pressure chamber 50 and attempt to move piston 14 toward a TDC position (block 154). The high pressure pulse is applied for a period of time represented by the constant $HP_{PUL}$ (decision block 156). Of course, the variable "time" can be reset to zero prior to opening the high pressure valve in block 154, or the value of the constant HPPUL may be adjusted to accommodate the already incremented value of the variable "time" which occurred in decision block 148.

After applying a high pressure pulse to piston 14, high pressure check valve is again decoupled from pressure chamber 50 and low pressure shutoff valve LPS is activated to attempt to move piston 14 to a BDC position activating position sensor S (block 158 and decision block 160). The variable "time" may of course again be reset to zero prior to the wait state occurring at decision block 160. If sensor S is activated within the allotted time represented by the constant $T_{RET}$, then control passes back to the main control routine at block 152 for firing free piston engine 10. On the other hand, if the sensor S was again not activated upon opening of low pressure shutoff valve LPS at decision block 160, then the variable SES is incremented by one (block 162) and a determination is made as to whether the value of the variable SES is greater than three (decision block 164). If the variable SES is less than or equal to three, then control passes back to block 144 and the return procedure repeats. Contrarily, if the return procedure has been repeated three times and the value of the variable SES is four or more, then a "service engine soon" light is displayed to a user (block 166).

Industrial Applicability

During use, piston 14 is reciprocally disposed within combustion cylinder 16. Piston 14 travels between a BDC position and a TDC position during a compression stroke and between a TDC position and a BDC position during a return stroke. Combustion air is introduced into combustion chamber 28 through combustion air inlet 22 and air scavenging channel 24. Fuel is controllably injected into combustion chamber 28 using a fuel injector 30. High pressure hydraulic fluid from high pressure hydraulic accumulator H is coupled with pressure chamber 50 during a return stroke of piston 14. A duration of time during which the high pressure hydraulic fluid is coupled with the pressure chamber is dependent upon the activation of a sensor S which senses piston 14 at or near a BDC position. If the free piston engine misfires and sensor S is not activated, then the high pressure hydraulic fluid is maintained in a coupled relationship with pressure chamber 50 to cause piston 14 to bounce back toward the TDC position, thereby increasing the energy within the non-combusted fuel and air mixture within combustion chamber 28 during a next compression stroke and likely causing combustion of the fuel and air mixture. If the misfire occurs for several cycles of the free piston engine corresponding to a preset total amount of time, a manual return procedure is initiated to retract piston 14 to a position allowing firing of the free piston engine.

With the method of the present invention, the piston is bounced back toward a TDC position upon occurrence of a misfire or initial start-up condition.

The same sensor which is used for timing fuel injection is also used to determine when a misfire occurs, and how long a pulse of high pressure fluid is coupled with the pressure chamber. The exhaust ports are not opened during initial start-up, thereby preventing unburned fuel from escaping.

Other aspects, objects and advantages of this invention can be obtained from a study of the drawings, the disclosure and the appended claims.

What is claimed is:

1. A method of operating a free piston internal combustion engine, comprising the steps of:

providing a housing including a combustion cylinder and a second cylinder;

providing a piston including a piston head reciprocally disposed within said combustion cylinder, a second head reciprocally disposed within said second cylinder, and a plunger rod interconnecting said piston head with said second head, said second head and said second cylinder defining a variable volume pressure chamber on a side of said second head generally opposite said interconnecting plunger rod;

pulsing a supply of hydraulic fluid from a high pressure hydraulic accumulator into said pressure chamber during a beginning portion of a compression stroke to cause said piston head to move toward a top dead center position in said combustion cylinder;

decoupling said high pressure hydraulic accumulator from said pressure chamber after said pulsing step;

coupling a low pressure hydraulic accumulator with said pressure chamber during a remaining portion of said compression stroke;

coupling said high pressure hydraulic accumulator with said pressure chamber when said piston head is traveling toward a bottom dead center position in said combustion cylinder during a return stroke;

providing a sensor for sensing a position of said piston in said combustion cylinder which is one of at and near said bottom dead center position and providing a corresponding signal; and maintaining said coupling between said high pressure hydraulic accumulator and said pressure chamber for a period of time, dependent upon said sensor signal and a length of said return stroke.

2. The method of claim 1, comprising the further step of repeating said pulsing step during a next compression stroke, said supply of hydraulic fluid being pulsed into said pressure chamber for said period of time during a portion of said next compression stroke, said portion of said next compression stroke being determined by said length of said return stroke.

3. The method of claim 1, wherein said sensor signal begins a discrete time period during which said high pressure hydraulic accumulator is coupled with said pressure chamber during a portion of a next compression stroke, and wherein said maintaining step ends at an end of said discrete time period.

4. The method of claim 1, wherein said maintaining step comprises coupling said high pressure hydraulic accumulator with said pressure chamber during all of a next compression stroke.

5. The method of claim 4, comprising the further steps of:

setting a total time period beginning with said second coupling step; and initiating a manual return procedure at an end of said total time period.

6. The method of claim 1, wherein said second coupling step comprises coupling said high pressure hydraulic accumulator with said pressure chamber when said piston head begins traveling toward said bottom dead center position during said return stroke.

7. The method of claim 1, wherein said sensor senses a position of said piston head which is one of at and near said bottom dead center position.

8. The method of claim 1, wherein said second cylinder comprises a hydraulic cylinder and said second head comprises a plunger head.

* * * * *